US008387555B2

(12) United States Patent
Wang

(10) Patent No.: US 8,387,555 B2
(45) Date of Patent: Mar. 5, 2013

(54) APPARATUS AND METHOD FOR ELECTROLESS NICKEL COATING OF TUBULAR STRUCTURES

(76) Inventor: Glenn H. Wang, Calgary (CA)

( * ) Notice: Subject to any disclaimer, the term of this patent is extended or adjusted under 35 U.S.C. 154(b) by 439 days.

(21) Appl. No.: 12/822,961

(22) Filed: Jun. 24, 2010

(65) Prior Publication Data

US 2010/0330276 A1 Dec. 30, 2010

Related U.S. Application Data

(60) Provisional application No. 61/220,997, filed on Jun. 26, 2009.

(51) Int. Cl.

| | |
|---|---|
| ***B05B 7/06*** | (2006.01) |
| ***B05B 7/00*** | (2006.01) |
| ***B05B 13/06*** | (2006.01) |
| ***B05C 5/00*** | (2006.01) |
| ***B05C 15/00*** | (2006.01) |
| ***B05C 3/00*** | (2006.01) |
| ***B05C 3/02*** | (2006.01) |

(52) U.S. Cl. ..... 118/313; 118/300; 118/315; 118/317; 118/400; 118/407

(58) Field of Classification Search ..... None
See application file for complete search history.

(56) References Cited

U.S. PATENT DOCUMENTS

| | | | | |
|---|---|---|---|---|
| 4,262,044 | A * | 4/1981 | Kuczma, Jr. | 427/438 |
| 4,309,959 | A * | 1/1982 | Yamagishi et al. | 118/664 |
| 6,245,389 | B1 | 6/2001 | Horikawa et al. | |

FOREIGN PATENT DOCUMENTS

| | | |
|---|---|---|
| CN | 1102862 A | 5/1995 |
| CN | 1900357 A | 1/2007 |
| FR | 2908493 A1 | 5/2008 |

OTHER PUBLICATIONS

Canadian Office Action, mailed Apr. 11, 2012, for corresponding Canadian Patent Application No. 2,708,464, 3 pages.

Pup Joints, URL=http://www.fmctechnologies.com/FluidControl/Flowline/Fittings/PupJoints.aspx, download date Jun. 25, 2009.

* cited by examiner

*Primary Examiner* — Dah-Wei Yuan
*Assistant Examiner* — Jethro Pence
(74) *Attorney, Agent, or Firm* — Seed IP Law Group PLLC

(57) ABSTRACT

Tubular structures, for example pipes, are coated at least in an interior thereof with a nickel containing coating via at least one distribution manifold with ports which are received in the interior of the tubular structure. An electroless nickel coating solution may be pumped or supplied via gravity feed to the distribution manifold. The tubular structure may concurrently be immersed in electroless nickel coating solution in a tank. A second distribution manifold may deliver electroless nickel coating solution to the interior of the tubular structure in an opposite direction from the first. The two distribution manifolds may be used as part of a support structure to lift or move the tubular structure. Additional tanks may hold other solutions, for instance cleaning solutions, etching solutions and rinses.

18 Claims, 3 Drawing Sheets

APPARATUS AND METHOD FOR ELECTROLESS NICKEL COATING OF TUBULAR STRUCTURES

CROSS REFERENCE TO RELATED APPLICATIONS

This application claims benefit under 35 U.S.C. 119(e) to U.S. provisional patent application Ser. No. 61/220,997 filed Jun. 26, 2009 which is incorporated herein by reference in its entirety.

BACKGROUND

1. Field

The present disclosure relates generally to coating metal pipes, and more particularly to applying a uniform coating to the interior of relatively long tubular structures.

2. Description of the Related Art

Electroless Nickel Coating ("ENC") is a nickel plating process for chemically applying nickel alloy deposits onto metallic substrates using an autocatalytic immersion process without the use of electrical current. ENC is often applied to relatively short tubular components (e.g., 10-foot lengths), by dipping individual lengths of pipe vertically into a sump tank or bath with vertically spaced spargers to inject solution into the long body of the pipe. This conventional coating technology suffers a number of limitations including the depth of the sump bath and correspondingly the height of the ceiling of the workspace into which the treated body must be positioned. Similarly, it is difficult and time consuming, thus inefficient, to secure the tubular substrates in position vertically while changing them and replenishing the solution between batches. A further disadvantage of the conventional vertical dipping process for coating long tubular structures is the limited ability to control the distribution of the nickel solute so as to permit it to plate long curved surfaces uniformly. In many applications it is important that the nickel coating be uniform. Further, for applications in oil-producing regions, it is often necessary to use much longer tubular goods (e.g., 40-foot lengths). Accordingly, it is desirable to find a way to consistently apply uniform electroless nickel coatings over very long curved surfaces.

Typically, ENC is only applied to shorter lengths of pup joints, because existing processes fail to efficiently coat full length tubular joints with consistent results. The prior art in the ENC industry has concentrated on teaching variations on vertically oriented bath tanks and pipes, which disadvantageously requires deep tanks and a tall building to plate long pipes. See, e.g., U.S. Pat. No. 4,262,044 and U.S. Pat. No. 6,245,389.

BRIEF SUMMARY

A system for applying a uniform electroless nickel coating to the interior of a bundle of long pipes, each pipe having an inlet end and an opposing outlet end may be summarized as including at least one distribution manifold, having a number of injection nozzles, for injecting a fluid into one end of each pipe in said bundle, said end in fluid communication with said interior; a reservoir having a supply of electroless nickel coating solution fluidly coupled to a pump that is fluidly coupled to said distribution manifold; and recirculation means for repeatedly returning said coating solution to said reservoir until the desired thickness of coating is reached. The solutes of the chemicals are replenished from time to time to ensure certain levels of concentration.

A method of using ENC to uniformly plate long tubular structures such as full length OCTG (Oil Country Tubular Goods) sections of pipe and well (surface and production) casing uniformly and efficiently may be summarized as including a nickel coating distributing evenly on an inner surface of long tubular structures (e.g., pipes) by generating circulations inside the pipes. According to certain aspects, pipes may be placed in a bath horizontally. According to certain aspects, multiple pipes may be arranged in bundles and the bundles placed in the bath horizontally. According to certain such aspects, multiple pipes may be coated simultaneously. According to at least one aspect, pipes may be coated efficiently and uniformly at decreased cost.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known formulations, process steps, and structures associated with ENC have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, which is as "including, but not limited to."

Figure 1:
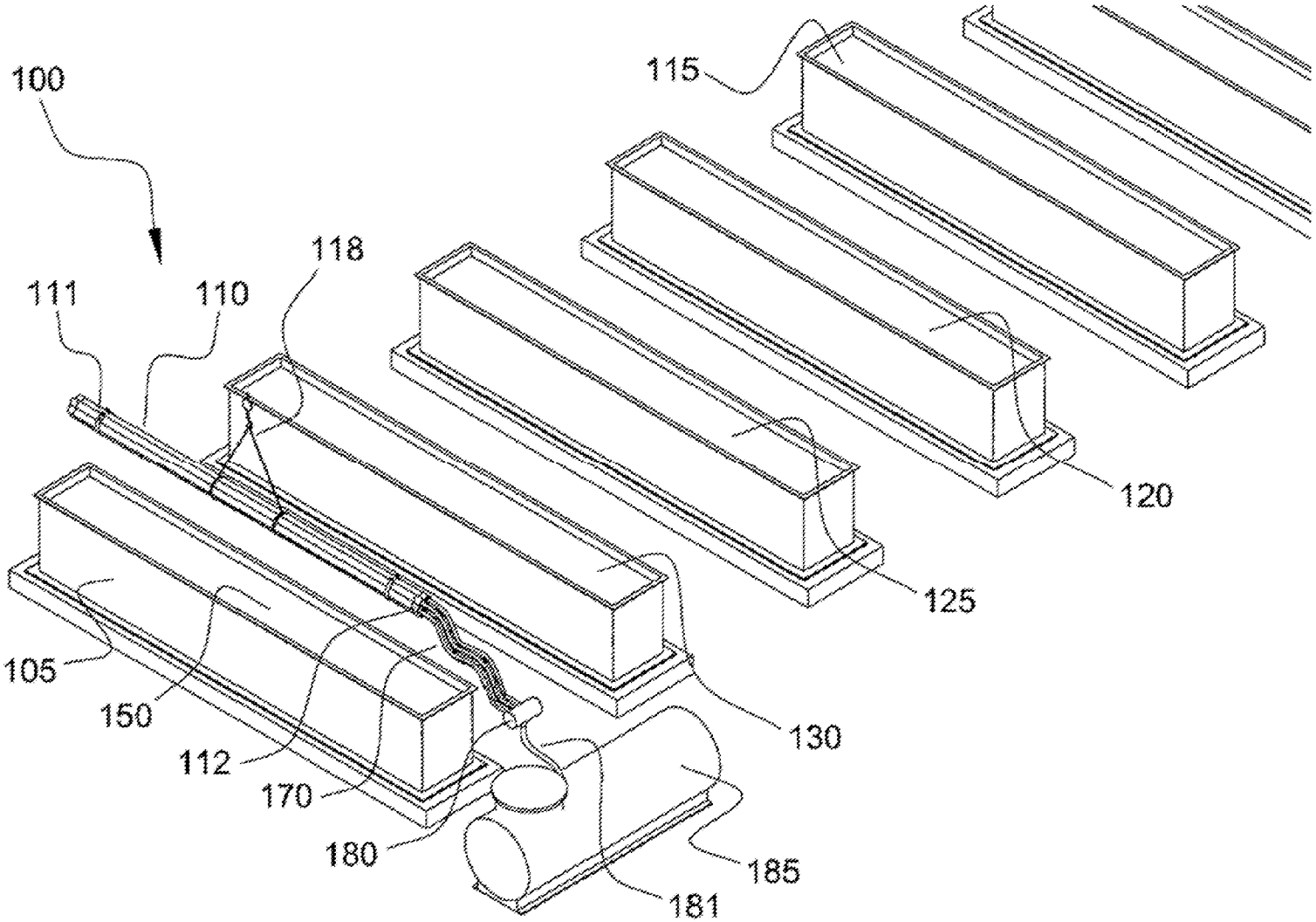
FIG. 1 is a top, front isometric view of a system for Electroless Nickel Coating long tubular structures such as pipes or tubes, according to one illustrated embodiment.
Figure 2:
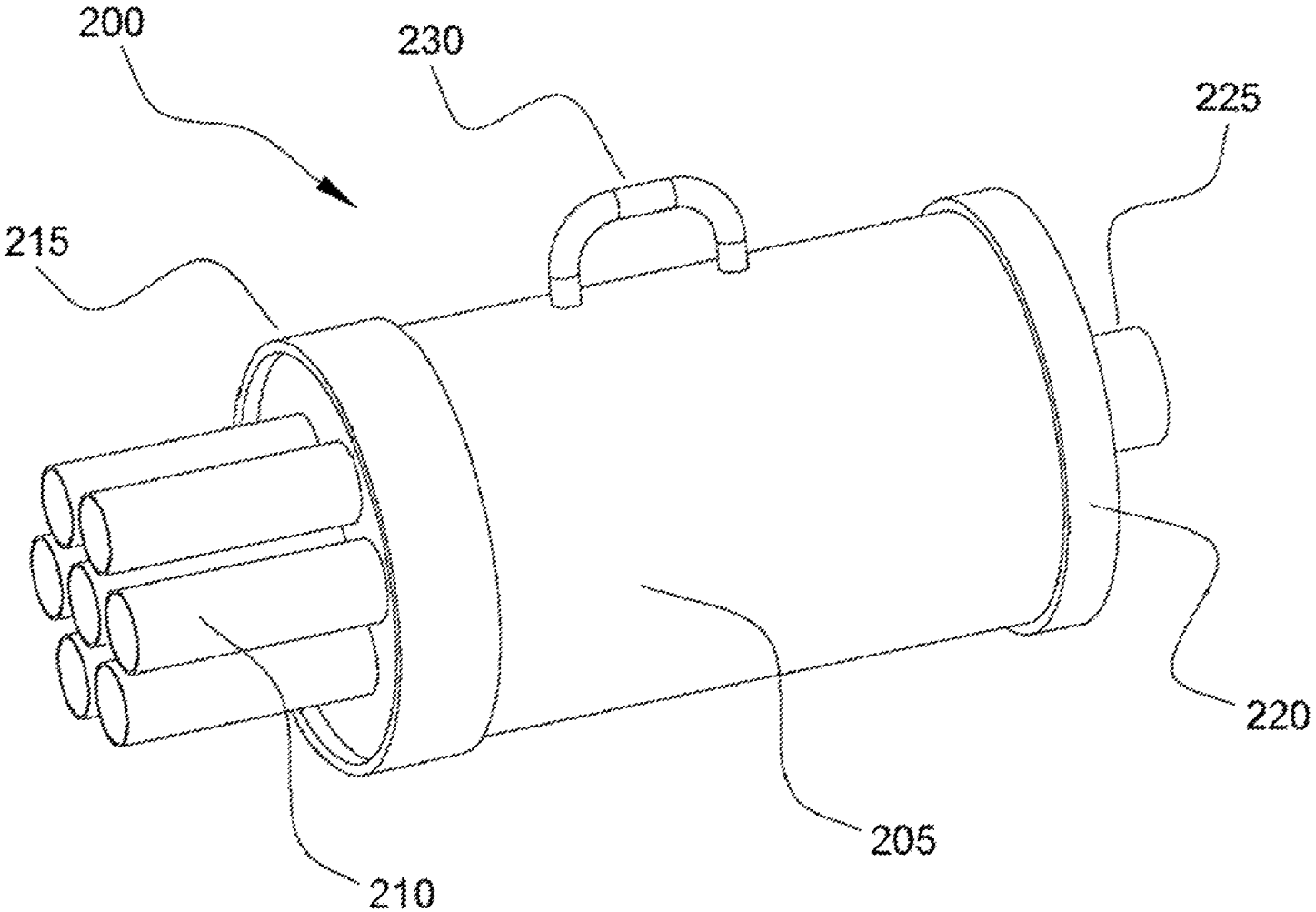
FIG. 2 is left side, front isometric view of a distribution manifold apparatus of the system for Electroless Nickel Coating, according to one illustrated embodiment.
Figure 3:
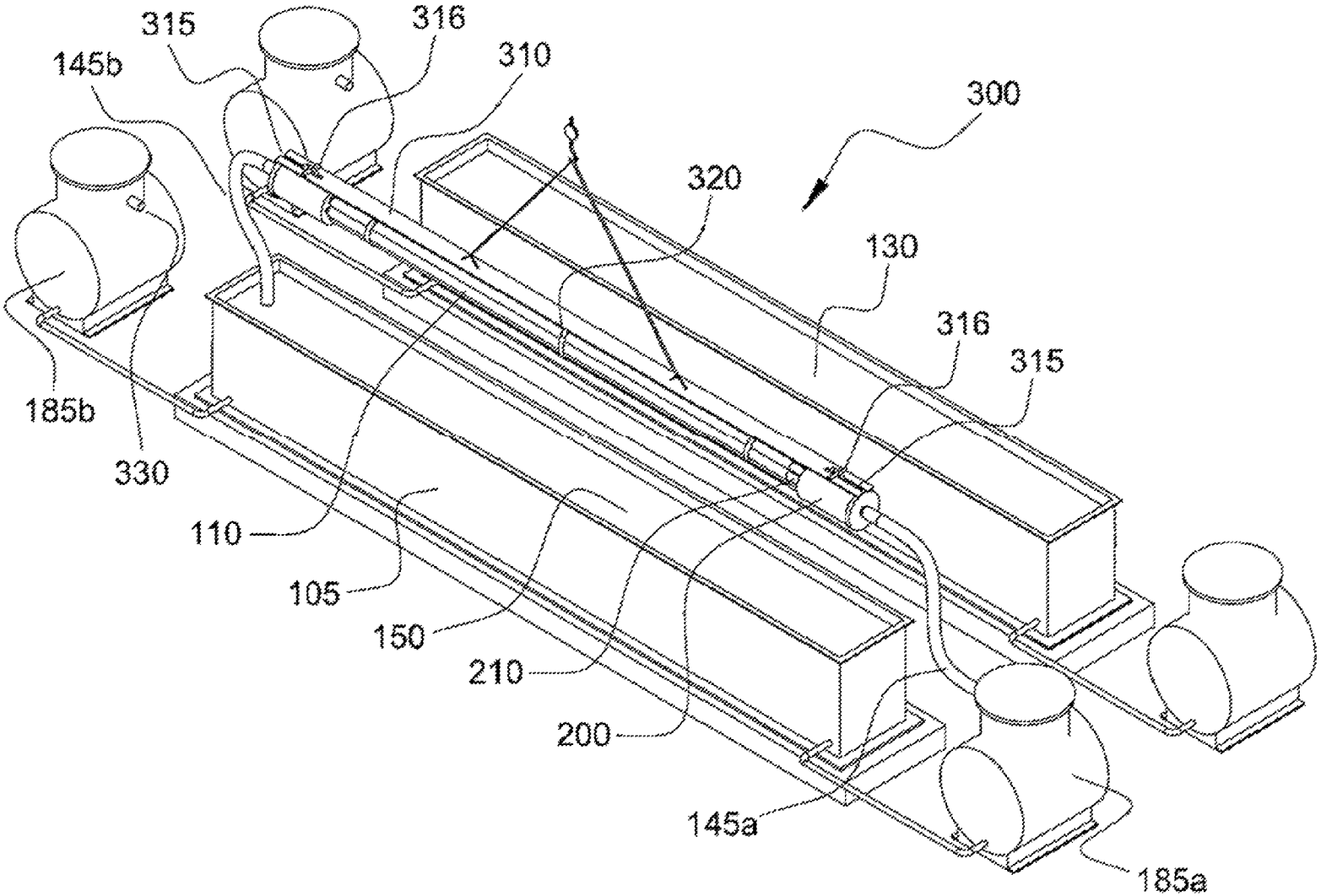
FIG. 3 is a top, front isometric view illustrating a system for Electroless Nickel Coating long tubular structures such as pipes or tubes, according to another illustrated embodiment.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Reference herein is made to FIGS. 1, 2, and 3 in which identical reference numbers identify similar components.

The term "tubulars" as used herein refers to tubular structures and includes tubing or piping having circular, rectangular, or other cross-sectional shapes and having lengths as appropriate. Lengths may, for example, extend to at least 40 feet or greater. Tubular structures, tubing, tubes, piping or pipes, including singular forms thereof, may be used interchangeably herein and in the claims.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

A number of embodiments of apparatus, systems and methods for Electroless Nickel Coating (ENC) are described herein. The ENC apparatus and systems perform ENC on pipes or tubing, particularly oil country pipes or tubing. As disclosed herein, the pipes or tubing may be advantageously positioned horizontally during ENC. Such horizontal positioning may advantageously allow nickel coating of lengths of pipe or tubing substantially greater than is allowed by apparatus, systems and methods commonly used for ENC, during which pipes or tubing are positioned vertically. Further, ENC by the apparatus, systems and methods disclosed herein may provide uniform nickel coating on curved surfaces of the pipes or tubing that is more uniform than can be provided by commonly used approaches to ENC.

FIG. 1 shows a system 100 for Electroless Nickel Coating (ENC) of long tubulars (circular, rectangular or other cross-sectional shapes). System 100 in the embodiment illustrated in FIG. 1 shows a plurality of relatively long tanks 105 (only one called out in the Figure) positioned proximal one another to form a "tank farm." Each tank 105 may have any cross-sectional shape or profile suitable for holding the tubular structures. Into each tank 105 a substantially horizontally positioned bundle 110 of full length tubulars 112 (only one denoted) may be immersed or drained. Due to the length and weight of a number of long metal pipes 112, suitably strong straps or other form of clamps 111 (only one denoted) are used to form the pipes 112 into bundle 110. The position of each tube within the bundle is further secured by any suitable spacers, wedges or similar means for this purpose (not shown).

Movement of bundles 110 of pipes 112 throughout the tank farm may be by any suitable means, for example without limitation clamp/strap/hook assembly 118. Transport of bundle 110 of pipes 112 via assembly 118 to any location within the tank farm may utilize any available overhead crane or forklift or similar means for moving bundle 110. Each tank in a treatment section of a farm contains a solution suitable for a given step in the ENC process. For cost and time efficiency, tubes 112 are preferably assembled into bundles 110 as discussed above. In the particular embodiment shown in FIG. 1, there are 7 tubes per bundle. However, size of the bundle may be varied and depends on available equipment and space, as well as production requirements. For example, in processing small orders of large diameter tubes one may choose to treat only 1 or 2 tubes at a time, whereas for large orders of smaller diameter tubes the system 100 may be used to treat 20 tubes or more at one time. By increasing tank size and lift capacity, even larger bundles may be assembled, then cleaned or coated together.

At least one tank contains a cleaning solution 115, for example an acid wash suitable to effect a preliminary macro cleaning of each tube 112 in bundle 110. Bundle 110 may preferably be dipped into cleaning solution 115 two or more times.

Another tank contains an appropriate rinse solution 120, for example water or a solution of a suitable detergent in water. Once the tubes 112 are sufficiently acid cleaned in solution 115 for the particular coating specified, the tubes 112 are moved to a tank containing the rinse solution 120. The tubes 112 may typically be immersed in the rinse solution 120. In certain embodiments the tubes may preferably be immersed therein two or more times, as necessary.

A further tank contains an etching solution 125 appropriate for the particular coating process to be used in ENC. Once tubes 112 are sufficiently rinsed, the tubes 112 are moved to a tank containing the etching solution 125 in which the tubes 112 are immersed. Immersion of tubes 112 into etching solution 125 may be complete or partial, depending on the degree of etching required for a particular coating.

Yet a further tank may contain a second rinse solution 130, for example water or a solution of a suitable detergent in water. Once the tubes 112 are sufficiently etched for the coating specified, the tubes 112 may be moved to and immersed in a tank containing an appropriate second rinse solution 130. The second rinse solution 130 may, for example, take the form of water or a solution of a suitable detergent in water. The final rinse may preferably be performed in purified water, such as may be obtained by reverse osmosis treatment. Each of these acts carried out prior to the coating step(s) may typically be completed at room temperature (e.g., 60-70° F.).

The final tank according to the embodiment illustrated in FIG. 1 contains coating solution 150. The coating solution 150 may preferably be heated to a temperature suitable for the coating process. Intake lines 181 for distribution manifold 180 draw the heated coating solution 150 from one side of tank 105 to inject the heated coating solution 150 into tubes 112 such that the heated coating solution 150 passes through each tube 112 and discharges into the opposing side and/or end of tank 105. Such ensures sufficient circulation and precipitative or other form of consumption of solute during the coating process permitting the bath of heated coating solution 150 to deplete in a manner that facilitates an even thickness of coating.

Cleaned, etched, and rinsed tubes 112 in bundle 110 are then ready for electroless nickel coating (ENC), the precise formulation of which coating solution 150 (preferably heated to a temperature in the range 80 to 99 degrees C.) depends upon the desired coating properties. The formulation of coating solution 150 depends on the desired properties of the coating to be applied to tubes 112. In one embodiment, coating solution 150 is preferably heated to a temperature ranging between 80° C. and 99° C. In certain embodiments, tubulars need only be coated on their internal surfaces. In preparation for coating, external surfaces of such tubulars may be protected by wrapping in any suitable covering, e.g., a polymer tape or any suitable paint such as epoxy). The covering may prevent the exterior surfaces of the tubulars from reacting to or with the nickel ions in coating solution 150.

Once any protective steps have been completed, the tubes 112, individually or in bundles 110 as appropriate, are moved by any suitable means into a tank containing an appropriate nickel alloy coating solution 150. The nickel solute concentration in the coating solution 150 is selected to achieve the desired thickness of coating of the surface area to be plated. In certain embodiments, the nickel alloy coating solution 150 may have a specific gravity of 1.14 and a viscosity of 0). In certain embodiments, the concentration of nickel solution in the coating solution 150 is selected to achieve a coating rate of 0.005 mm/hour-0.015 mm/hour on the surfaces of the tube(s) to be coated. In certain embodiments, the temperature of the coating solution 150 ranges between 80° C. and 95° C. In certain embodiments the concentration of nickel solute in the coating solution 150 is 30% or less. The temperature and chemical formulation of the coating solution 150 are established according to the expected end use of tube 112 and the coating properties required for that use. Prior to immersing tube bundle 110 into coating solution 150, hoses 170 connected to distribution manifold 180 are fluidly coupled, by any suitable means, to either end of each tube 112 in bundle 110.

According to one embodiment of the apparatus and system disclosed herein, each hose 170 is inserted into an end of each tube 112. Distribution manifold 180 is fluidly coupled via input line 181 to a supply (typically pressurized, however it could be gravitationally fed) of nickel alloy solution corresponding to coating solution 150. The supply may be fed gravitationally or further pressurized. The coating solution 150 may be supplied from or circulated through a reservoir 185. The coating solution 150 may be circulated through the tubes 112 and tank 105 by being steadily driven by any suitable pump (not shown) fluidly coupled to reservoir 185 and operated at a flow rate sufficient to circulate coating solution 150 through tank 105. Circulation through the system may be at a rate of 15 to 30 times per hour, thereby keeping the coating solution 150 well mixed and sufficiently uniform in concentration, thus helping to provide an even coating on the relatively long curved surfaces of the tubes 112 being plated. Circulation of the coating solution 150 within the system may occur by gentle backwash or recirculation. In certain embodiments, flow of coating solution 150 within the tubes 112 during coating is preferably laminar flow rather than turbulent flow to more uniformly provide coating solution to the surfaces to be coated. In certain further embodiments, bundle 110 may be gently rotated, e.g., driven by any suitable rotisserie-like motor means, to more uniformly provide coating solution to the interior surface of each tube 112. The particular flow rate selected depends upon the specifications of the coating type and thickness. The deposition rate of a given nickel alloy is influenced by a number of factors including the nozzle pressure at hose 170 and the related velocity with which the nickel alloy coating solution 150 passes over the interior surface of each tube 112.

Upon completion of coating and depletion of solute from coating solution 150, bundle 110 of the now nickel alloy-coated tubes 112 is removed from coating solution 150 and allowed to cool to near room temperature. The bundle 110 of tubes 112 is then again rinsed in pure water, typically dipped three times for a few seconds each time. According to one embodiment, the tubes are then exposed to the air at room temperature for approximately 1 minute for passivation. Passivation refers to a process of making the coating "passive" by spontaneous formation of a hard surface film, usually an oxide or nitride, a few atoms thick, on the surface of the coated and rinsed tubes 112 in bundle 110. Passivation seals cracks or pinholes in the coating, which helps maintain surface hardness, improves surface glare, and increases the life span of the surface coating.

According to another embodiment, where additional surface coating hardness is required, bundle 110 of tubes 112, after coating, is subjected to heat treatment via baking. In certain embodiments, baking of the tubes 112 is performed at a temperature between 300 and 400° C. for 1 to 3 hours. In certain embodiments, the temperature and time may be varied inversely. Upon completion of baking, the bundle 110 of tubes 112 is allowed to cool at room temperature (in air) to permit the coating bonds to stabilize and tube surfaces to anneal, thus increasing the hardness of the coating. It is to be understood that a person of ordinary skill in the art of heat treatment would know to set the particular temperature and time in accordance with the specified hardness required in the tubes 112 in use. The tubes 112 are typically cleaned (e.g., rinsed) one final time before packing for shipping.

FIG. 2 shows an alternative embodiment of distribution manifold 180, denoted generally as 200, comprising manifold reservoir 205, a suitable number of filler nozzles 210 (only one denoted), end cap 220, inlet 225, and support member 230. Optional collar 215 slidingly coaxially engages reservoir 205 with the inner diameter of collar 215 sized to closely receive and accommodate the outer diameter of reservoir 205. Whereas filler nozzles 210 are provided in sufficient number for supplying each tube 112 in bundle 110 and are each externally sized for close reception by the interior of their corresponding tube 112. Collar 215 may advantageously be slidingly moved away from full engagement with reservoir 205 to be positioned around the exterior of the entire bundle 110, thereby permitting apparatus 200 to also provide mechanical support for holding and lifting bundle 110, in addition to or as an alternative to clamps 111 denoted in FIG. 1.

Reservoir 205 may be any suitable shape, dimensions and capacity applicable to deliver the specified coating solution to the particular number of tubes 112 comprising the particular bundle 110 used in a particular application of embodiments of the system disclosed herein. Similarly, filler nozzles 210 are provided in sufficient number and of a size that corresponds to the shape and dimensions of the tubulars being coated. Further, filler nozzles 210 may be constructed from a material and in a manner providing enough strength to permit apparatus 200 to support an end of bundle 110. However, when used with alternate means for supporting the ends of a bundle (e.g. using clamps 111), filler nozzles 210 may be constructed from a light weight material (e.g. stubs of hose 170) that directs solution into each tube 112 without providing means to either maintain or lift a bundle of tubes of any size.

Regardless of the capacity of distribution manifold apparatus 200 to maintain the relative position of tubes 112 in a bundle 110, according to a preferred embodiment of the apparatus, advantageously there is provided a removable end cap 220 that is removably fastened (by any suitable means) to the opposing end of reservoir 205. Such permits periodic cleaning and allows an operator to leave apparatus 200 in place while changing the solution being supplied to bundle 110. Whether threaded, slip fit and bolted or riveted—or otherwise sealed to one end of reservoir 205, end cap 220 (having any suitable inlet 225 provided therein) permits the rapid, seamless change out of supply lines both feeding and draining cleaning or treatment solutions to, or from, bundle 110.

According to one embodiment of distribution manifold apparatus 200 that both maintains the shape of bundle 110 and permits an operator to move that bundle throughout a tank farm, support member 230 both facilitates the installation of apparatus 200 into each end of a bundle 110 and permits that bundle to be secured to any suitable lifting means.

FIG. 3 shows a system 300, according to an alternative embodiment. In the system 300, each distribution manifold 200 serves more than one purpose and system 300. Accordingly to this embodiment, bundle 110 is assembled with a clamp 111 and suitable spacer positioned approximately mid-length along the bundle. Then, typically handling one end at a time, a pair of distribution manifolds 200 are inserted into opposite ends of the bundle 110 of tubes 112. The distribution manifolds 200 are fastened to support beam 310 to add rigidity and to obtain control over the bundle. End caps 220 need not be installed during bundle-to-beam assembly. Once the distribution manifolds, tubes, clamps, and support beam are all connected, bundle 110 may be processed through the tank farm for: cleaning, etching, rinsing, coating, and rinsing as required for the product sought. Advantageously, whenever only the interior of tubes 112 is being treated, system 300 may be configured to complete the process without the need for dipping and immersion into the tanks 105. Tanks 105 may instead act as alternate reservoirs holding the different cleaning, rinsing, etching, coating and other solutions. Such solutions may be pumped only through tubes 112, then either recirculated to the same reservoir until the solute is depleted, or to an intermediate reservoir where the concentration of the solution may be monitored and reconditioned or disposed of accordingly.

According to the embodiment illustrated in FIG. 3, one distribution manifold apparatus 200 is connected to each end of tubes 112 in bundle 110 to permit bi-directional flow and the interchangeability of supply tanks 185*a*, 185*b*. As illustrated, lifting support beam 310 provides a slot 315 in each end for closely accommodating support member 230 (denoted in FIG. 2) through which any suitable pin 316 may be removably inserted so as to releaseably fasten each apparatus 200 (and bundle 110 situated between them) to support beam 310 for movement throughout the tank farm. As shown, solution from supply tank 185*a* may be supplied to bundle 110 through supply line 145*a* and permitted to flow back into tank 105 via supply line 145*b*. Supply line 145*b* may alternately be connected for recirculation to inlet/outlet 330 of supply tank 185*b* and vice versa. Advantageously, system 300 permits the ENC treatment process to be completed using a smaller tank farm with fewer operations whenever immersion can be avoided. It is contemplated that a siding and hinged configuration of apparatus 200 could be connected to support beam 300 together with a center grapple 320 so as to facilitate more automated processing of bundle 110. Such would allow an operator to slide each tube 112 into place over injection nozzles 210 on one end and then operate the hinge and slide on the opposing distribution manifold apparatus 200, causing all injection nozzles 210 on that opposing end to simultaneously engage and become fluidly coupled to that end of their respective tubes 112. This same embodiment contemplates a reservoir 205 (together with its injection nozzles 210 and collar 215) that rotates inside a fixed sleeve (not shown) to which the hinged sliding subassembly is coupled for connection to support beam 310. This rotating distribution manifold embodiment causes the entire bundle 110 to rotate gently while solution is being circulated through the interior of each tube 112 ensuring an even coating.

Although the disclosure describes and illustrates various embodiments, it is to be understood that these particular embodiments are provided without limitation. As a direct result of this disclosure, variations and modifications will now occur to those skilled in the art of Electroless Nickel Coating for longer tubulars. The various embodiments described above can be combined to provide further embodiments. To the extent that they are not inconsistent with the specific teachings and definitions herein, all commonly assigned U.S. patents, U.S. patent application publications, U.S. patent applications, referred to in this specification and/or listed in the Application Data Sheet are incorporated herein by reference, in their entirety. Aspects of the embodiments can be modified, if necessary, to employ structures and concepts of the various patents and applications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not to be construed as being limited by the disclosure.

I claim:

1. A system to apply a substantially uniform electroless nickel coating to an interior of tubular structures having at least a first opening at least proximate a first end thereof and a second opening at least proximate a second end thereof, the system comprising:

at least a first tank to hold a solution for use in an electroless nickel coating process, the first tank sized to receive at least one tubular structure therein;

at least a first distribution manifold having a number of injection ports, at least a portion of the first distribution manifold having the injections ports sized to be received in at least one of the first or the second ends of the at least one tubular structure, and to be retained therein at least while the at least one tubular structure is received in the first tank;

a reservoir to hold a supply of an electroless nickel coating solution, the reservoir fluidly coupled to the injections ports of at least the first distribution manifold to deliver the electroless nickel coating solution from the reservoir to the injection ports of the first distribution manifold and thereby to an interior of the at least one tubular structure when the at least one tubular structure is received in the first tank; and a recirculation subsystem that repeatedly returns the electroless nickel coating solution to the reservoir.

2. The system of claim 1 wherein the first tank is to hold a coating solution comprising nickel and the at least a portion of the first distribution manifold having the injections ports is sized to be retained in at least one of the first or the second ends of respective ones of the at least one tubular structure at least while the at least one tubular structure is received in the first tank.

3. The system of claim 2, further comprising:

at least a second tank to hold a cleaning solution, the second tank sized to receive at least one tubular structure therein; and at least a third tank to hold a first rinse agent, the third tank sized to receive at least one tubular structure therein.

4. The system of claim 3, further comprising:

at least a fourth tank to hold an etchant solution, the fourth tank sized to receive at least one tubular structure therein.

5. The system of claim 4, further comprising:

at least a fifth tank to hold a second rinse agent, the fourth tank sized to receive at least one tubular structure therein.

6. The system of claim 2 wherein the first tank is sized to receive the at least one tubular structure fully immersed in the coating solution therein.

7. The system of claim 2 wherein the first tank is sized to receive a bundle of a plurality of tubular structures fully immersed in the coating solution therein.

8. The system of claim 2, further comprising:

a heater that heats the electroless nickel coating solution in the first tank.

9. The system of claim 8 wherein the heater heats the electroless nickel coating solution to between about 80° C. and about 90° C.

10. The system of claim 1, further comprising:

a pump fluidly operable to provide the electroless nickel coating solution to at least the first distribution manifold under pressure.

11. The system of claim 1 wherein the reservoir is positioned relatively higher than the first tank and the electroless nickel coating solution is supplied to the injection ports only under the force of gravity without any pump.

12. The system of claim 10 wherein the pump is fluidly coupled between the reservoir and at least the first distribution manifold.

13. The system of claim 1 wherein the injection ports are nozzles.

14. The system of claim 1 wherein the recirculation subsystem repeatedly returns the electroless nickel coating solution to the reservoir until a solute therein is depleted.

15. The system of claim 1, further comprising:

a second distribution manifold having a number of injection ports, at least a portion of the second distribution manifold having the injections ports sized is amended to recite to be received in the other the at end of the at least one tubular structure in which the portion of the first distribution manifold is received.

16. The system of claim 15, further comprising:

a support beam to which the first and the second distribution manifolds are detachably selectively coupleable.

17. The system of claim 16 wherein the support beam has a first end and a second end and the first and second distributions manifolds are detachably selectively coupleable to the support beam at least proximate the first and second ends, respectively.

18. The system of claim 15 wherein the second distribution manifold is coupled to supply the electroless nickel coating solution through at least a portion of the at least one tubular structure in a direction opposite to a direction in which the first distribution manifold supplies the electroless nickel coating solution through the at least one tubular structure.

* * * * *

UNITED STATES PATENT AND TRADEMARK OFFICE

CERTIFICATE OF CORRECTION

PATENT NO. : 8,387,555 B2
APPLICATION NO. : 12/822961
DATED : March 5, 2013
INVENTOR(S) : Glenn H. Wang It is certified that error appears in the above-identified patent and that said Letters Patent is hereby corrected as shown below:

In the claims

Column 8, Line 42:
"ends of respective ones of the at least one tubular structure at" should read, --ends of the at least one tubular structure at--.

Column 10, Lines 1-2:
"manifold having the injections ports sized is amended to recite to be received in the other the at end of the at least" should read, --manifold having the injections ports sized to be received in the other end of the at least--.

Signed and Sealed this
Ninth Day of February, 2016

Michelle K. Lee

Michelle K. Lee
*Director of the United States Patent and Trademark Office*